US007997905B2

(12) United States Patent
Denk et al.

(10) Patent No.: US 7,997,905 B2
(45) Date of Patent: Aug. 16, 2011

(54) MACHINE TOOL OR PRODUCTION MACHINE OR ROBOT

(75) Inventors: Joachim Denk, Nürnberg (DE); Gerd Griepentrog, Gutenstetten (DE); Klaus Hertinger, Erlangen (DE); Hubert Schierling, Erlangen (DE); Richard Schmidt, Baiersdorf (DE); Ulrich Wetzel, Berga (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 12/308,425

(22) PCT Filed: Apr. 13, 2007

(86) PCT No.: PCT/EP2007/053608

§ 371 (c)(1),
(2), (4) Date: Aug. 30, 2010

(87) PCT Pub. No.: WO2007/147657

PCT Pub. Date: Dec. 27, 2007

(65) Prior Publication Data

US 2010/0317201 A1 Dec. 16, 2010

(30) Foreign Application Priority Data

Jun. 22, 2006 (DE) ..... 10 2006 028 647

(51) Int. Cl.
*H01R 39/30* (2006.01)

(52) U.S. Cl. ..... 439/5

(58) Field of Classification Search ..... 439/5, 13, 439/17, 21, 19; 310/219, 232; 343/760
See application file for complete search history.

(56) References Cited

U.S. PATENT DOCUMENTS

| | | | | |
|---|---|---|---|---|
| 3,295,091 | A * | 12/1966 | Von Mossin | 439/5 |
| 6,612,847 | B2 * | 9/2003 | Canizales, Jr. | 439/17 |
| 2003/0162422 | A1 * | 8/2003 | Sobhani | 439/86 |
| 2005/0242910 | A1 * | 11/2005 | Balsells | 335/220 |

FOREIGN PATENT DOCUMENTS

| | | | |
|---|---|---|---|
| DE | 2230332 | A1 | 1/1974 |
| DE | 2536154 | B1 | 11/1976 |
| DE | 29619491 | U1 | 12/1996 |
| FR | 1462050 | A | 2/1967 |
| FR | 2755799 | A1 | 5/1998 |
| WO | WO 2005/062432 | A1 | 7/2005 |
| WO | WO 2005119857 | A1 | 12/2005 |

* cited by examiner

*Primary Examiner* — Alexander Gilman

(57) ABSTRACT

A machine tool or a production machine, such as e.g. a multispindle machine, or a robot, is described, wherein a liquid metal lubricated slide bearing is not only used to transmit feed currents for electrical consumers but also to transmit currents for producing control signals. Accordingly, it is possible to apply via the liquid metal lubricated slide bearings a voltage of 600 volts in order to produce feed currents and a voltage of 24 volts in order to produce control signals.

10 Claims, 4 Drawing Sheets

MACHINE TOOL OR PRODUCTION MACHINE OR ROBOT

CROSS REFERENCE TO RELATED APPLICATIONS

This application is the US National Stage of International Application No. PCT/EP2007/053608 filed Apr. 13, 2007 and claims the benefit thereof. The International Application claims the benefits of German application No. 10 2006 028 647.2 DE filed Jun. 22, 2006, both of the applications are incorporated by reference herein in their entirety.

FIELD OF INVENTION

The invention relates to a machine tool or production machine or robot, with a fixed part and a part that rotates in relation thereto. The machine tool can be a multispindle machine or a revolving transfer machine. Production machines corresponding to the definition are found for example in beverage filling plants.

In the case of multispindle machines, a number of spindle motors (electrical consumers) are mounted on the rotating part, known as the drum.

In the case of machine tools or production machines or robots of the type mentioned above, it is always problematic supplying consumers on or at the rotating part with currents for feed purposes. At the same time signals to control the consumers have to be transmitted in the case of machine tools or production machines.

Generally current is supplied to the rotating part in the field by way of slip rings. These slip rings are subject to mechanical abrasion, in other words wear. Ensuring interruption-free transmission is technically complex.

BACKGROUND OF INVENTION

It is known from WO 2005/062432 A1 that liquid metal alloys can be used instead of the conventional copper slip ring contacts. To this end a current transmission surface is provided respectively on the fixed part and on the part rotating in relation thereto, with the two current transmission surfaces forming a gap between one another, into which the liquid metal alloy is inserted. This creates an electrical contact and at the same time does not restrict the rotatability of the rotating part in relation to the fixed part.

WO 2005/062432 A1 only discloses the transmission of a feed current via three current transmission contact units isolated galvanically from one another.

SUMMARY OF INVENTION

An object of the invention is to develop a machine tool or production machine of the type mentioned in the introduction in such a manner that both transmission of the feed current and production of control signals are facilitated.

This object is achieved by a machine tool or production machine or a robot as claimed in the claims.

The fixed part therefore has four current transmission surfaces, which are insulated electrically from one another, and the rotating part also has four such electrically insulated current transmission surfaces, with each of the four current transmission surfaces of the fixed part being assigned respectively to a current transmission surface of the rotating part, a gap being formed between them and a liquid metal alloy being inserted into the gap. This produces a current transmission contact in each instance, overall at least four current transmission contacts.

It is then possible for two first current transmission contacts to be deployed to feed a first electrical consumer on the rotating part and two further current transmission contacts to be deployed to feed a second electrical consumer, which produces control signals for the first electrical consumer.

The voltage ranges deployed are preferably completely different here. Thus a voltage of 400 to 1000 volts can be applied to the first current transmission contacts and a voltage of 10 to 45 volts can be applied to the further current transmission contacts. Consideration is given here to a voltage of 600 volts, which is required to feed the electrical consumers in the case of a typical multispindle machine, and a voltage of 24 volts, which serves to produce the control signals.

A fifth contact, which does not necessarily have to be referred to as a current transmission contact, is preferably connected to ground. In other words there is a fifth contact surface on both the fixed and rotating parts of the machine respectively, together forming a gap, in which the liquid metal alloy is contained, with the entire contact being connected to ground by connecting the fifth contact surface of the fixed part to ground. The voltages applied to the current transmission surfaces are stabilized by the ground connection.

In the case of multispindle machines there is commonly an arrangement, in which the fixed and rotating parts respectively are hollow cylinders, with one part enclosing the other and with the part enclosed by the other part having a cylinder wall. When conventional copper slip contacts are used, the power cables are generally guided in the air-filled internal space of the hollow cylinder. It is a particular aspect, irrespective of the use of the four current transmission contacts, that the current supply systems are guided to the current transmission surfaces in the cylinder wall of the part enclosed by the other part. Guiding the current supply systems in the cylinder wall means that the hollow space of the cylinder can be used for other purposes, for example for the passage of other materials, such as cooling and hydraulic oils.

The enclosing part can also have a cylinder wall, in which current supply systems are guided to the current transmission surfaces. If the enclosed part is fixed for example, this means that the current supply systems are guided in the cylinder walls in the rotating part too. This produces a relatively compact structure.

A further aspect of the invention is the embodiment of the current transmission contacts. This aspect is independent of the invention claimed in the independent claims, even if it is preferably executed at the same time as it. According to this aspect, one of the two parts encloses the other, the fixed part and rotating part being cylindrical. A ring of U-shaped cross-section is provided on one cylinder wall of the one part to provide a current transmission surface. A ring of L-shaped cross-section is provided on the cylinder wall of the other part to provide a current transmission surface. The current transmission contacts are then formed by inserting (a liquid metal alloy) in the ring of U-shaped cross-section and by an arm of the "L" engaging in the "U" and thereby engaging in the liquid metal alloy. The engaging arm of the "L" then has to be sealed off from the two arms of the "U", so that the liquid metal alloy cannot escape from the U-shaped ring.

Using the bending L-shaped ring allows the U-shaped ring to be guided almost up to the other part, to which it is not secured. This allows a particularly compact embodiment of the current transmission contacts.

BRIEF DESCRIPTION OF THE DRAWINGS

Preferred embodiments of the invention are described below with reference to the drawings, in which.

DETAILED DESCRIPTION OF INVENTION

Figure 1:
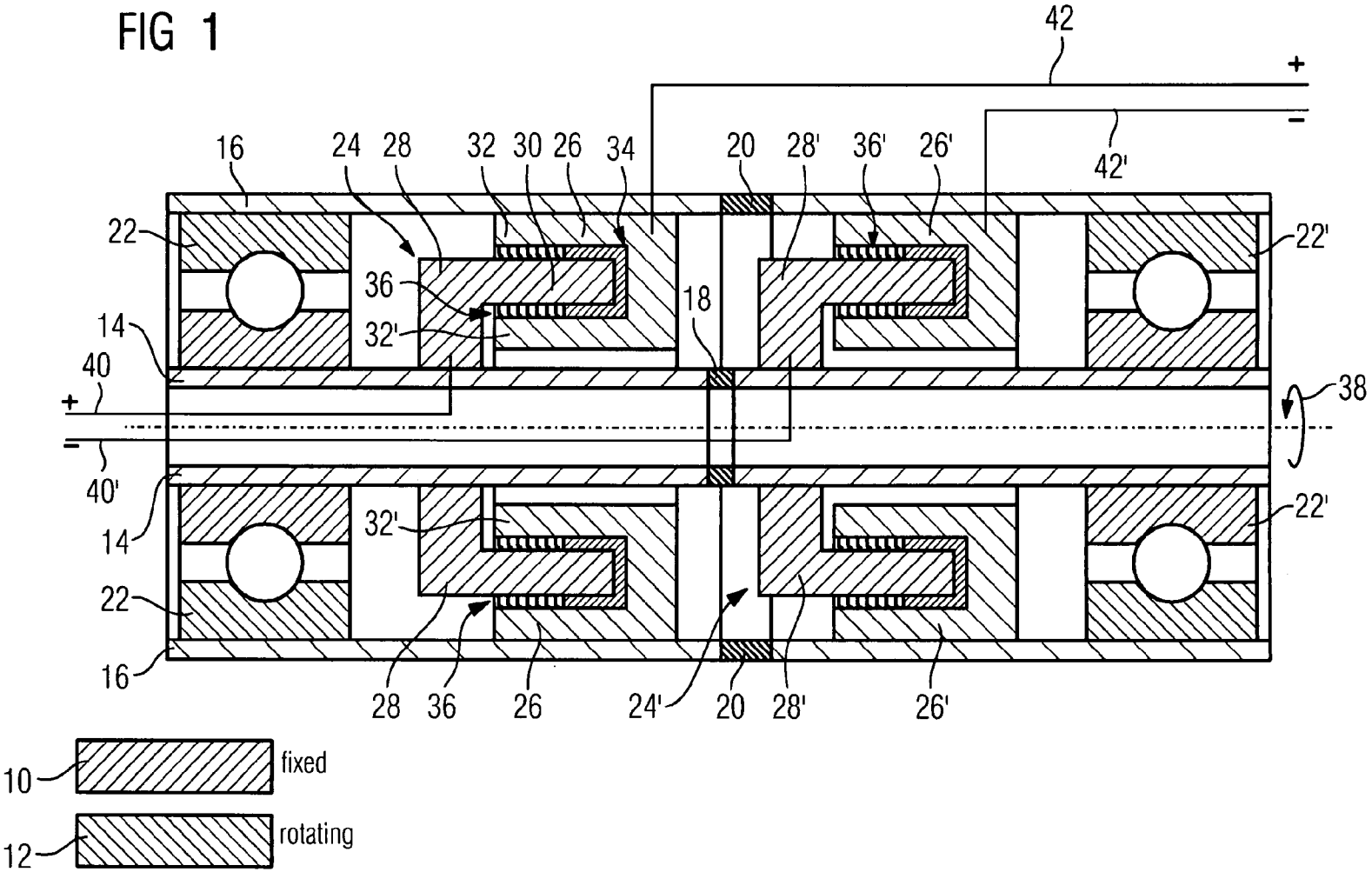
FIG. 1 shows a schematic diagram of current transmission.

FIG. 1 shows the basic structural elements of a machine tool or production machine, namely a fixed part 10 and a rotating part 12, it being possible to differentiate the parts 10 and 12 due to different shading (see key).

The fixed part has a basic body in the form of a hollow cylinder with a cylinder wall 14. The rotating part also has a basic body in the form of a hollow cylinder with a cylinder wall 16. The cylinder wall 14 of the fixed part 10 has an insulating ring 18 to separate the cylinder wall 14 into two parts that are insulated from one another. Similarly the cylinder wall 16 of the rotating part 12 has an insulating ring 20.

The rotating part 12 is actually supported in relation to the fixed part 10 by means of radial ball bearings 22 and/or 22'. Current transmission contacts 24 and 24' are used for current transmission. The current transmission contacts 24 and/or 24' are formed by two rings 26 and/or 26' and 28 and/or 28'. The ring 26 is connected permanently to the cylinder wall 16 of the rotating part 12 and has a U-shaped profile, with one arm 32 of the "U" resting on the inside of the cylinder wall 16, so that the "U" profile is a horizontal profile. The ring 28 is connected permanently to the cylinder wall 14 of the fixed part 10 and is of L-shaped cross-section. One arm of the "L" here engages between two arms 32 and 32' of the "U". Between the end of the arm 30 and the ring 26 a gap 34 is formed, into which a liquid metal alloy 34 is inserted. Sealing lips 36 and/or 36' are located between the arm 30 of the L-ring and the arms 32 and/or 32' of the U-ring, so that the liquid metal alloy cannot escape from the U-shaped ring 26.

The arrangement allows rotation of the rotating part 12 in relation to the fixed part 10 about the axis 38. The bearings 22 and 22' are mainly acting here but the current transmission contacts 24 and/or 24' also function as bearings. They do not prevent rotation, as the liquid metal alloy inside the gap 34 ensures a sliding movement of the ring 26 in relation to the ring 28, with in particular the arms 32 and 32' of the U-profile rotating about the arm 30 of the L-profile. It is now possible to transmit current with the aid of the current transmission contacts 24 and 24'. A corresponding voltage (characterized by the signs "+" and "−") can be applied by way of power lines 40 and/or 40' to the rings 28 and/or 28'. The liquid metal alloy in the gap 34 means that the corresponding voltage is also applied on the side of the rotating part 12 and can be tapped by way of power lines 42 and/or 42'. The applied voltage can be a voltage of 600 volts. Such a voltage can be used to feed electrical consumers, which are affixed to the rotating part 12, with the power lines 42 and 42' having to be connected respectively to the electrical consumers. The power lines 40 and 40' are connected to a fixed device outside the machine, e.g. a control cabinet.

As well as the feeding of electrical consumers, activation of the electrical consumers can also take place. In the case of multispindle machines in particular the motors as electrical consumers have a motor controller, to which control signals are to be supplied on the part of the fixed part. The two current transmission contacts 24 and 24' can also be used to transmit such control signals, with the voltage present then being typically 24 volts.

Figure 2:
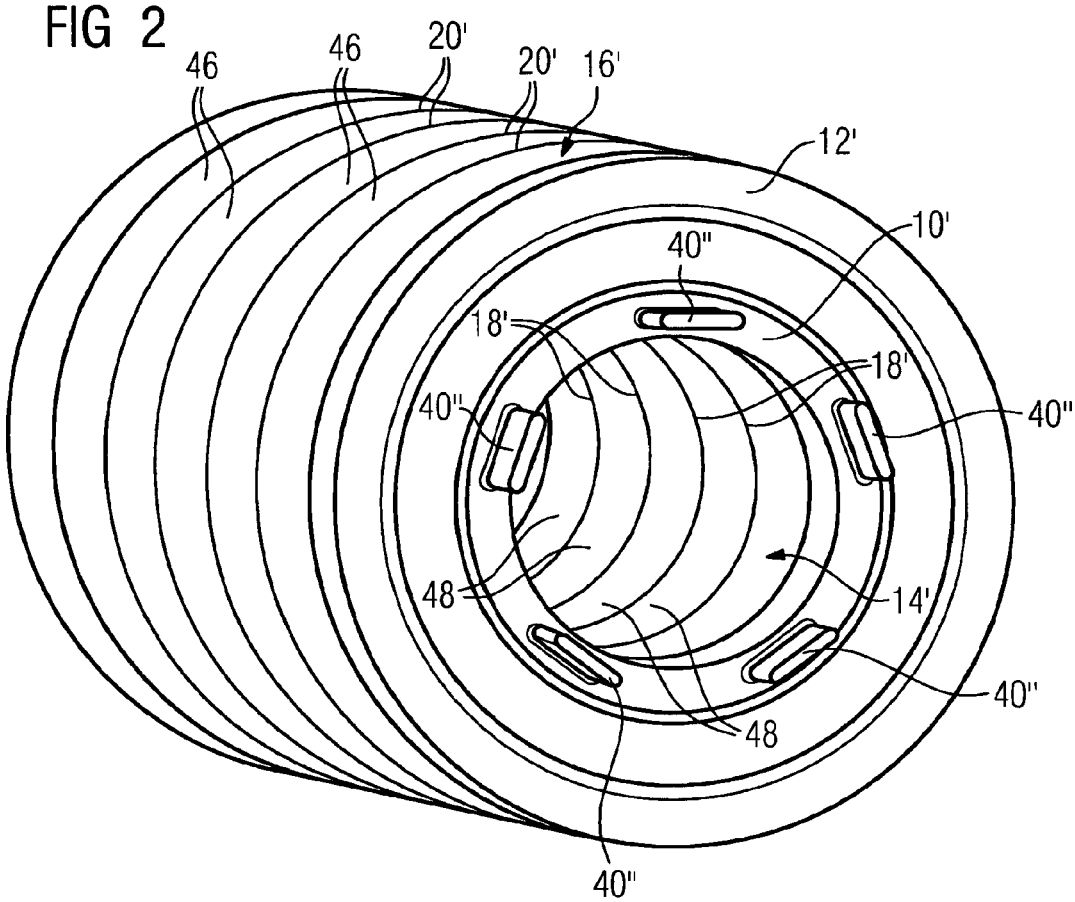
FIG. 2 shows a perspective view of a transmitter unit of an machine with power rails and FIG. 3A and FIG. 3B show perspective views from different directions of an individual element of the transmitter unit from FIG. 2 with associated power rails.

FIG. 2 shows a perspective view of a transmitter unit corresponding to FIG. 1. It shows the rotating part 12', which is configured as a hollow cylinder, and the fixed part 10'. FIG. 2 shows an addition to the arrangement in FIG. 1. The cylinder wall 16' of the rotating part is divided into five electrically insulated elements 46 by four insulating rings 20'. The cylinder wall 14' of the fixed part 10' is also correspondingly divided into five electrically insulated elements by four insulating rings 18'. A contact in the manner of the current transmission contacts 24 and/or 24' is now to be assigned to each of these five elements 48; in other words instead of two contacts 24 and 24' the arrangement according to FIG. 2 has five such contacts in its interior, which cannot be seen. By providing five current transmission contacts in the manner of the contacts 24 and 24' shown in FIG. 1 it is possible to apply two voltages, each voltage requiring two of the units, between which the voltage is applied. The fifth unit serves to provide a ground connection.

Figure 3A:
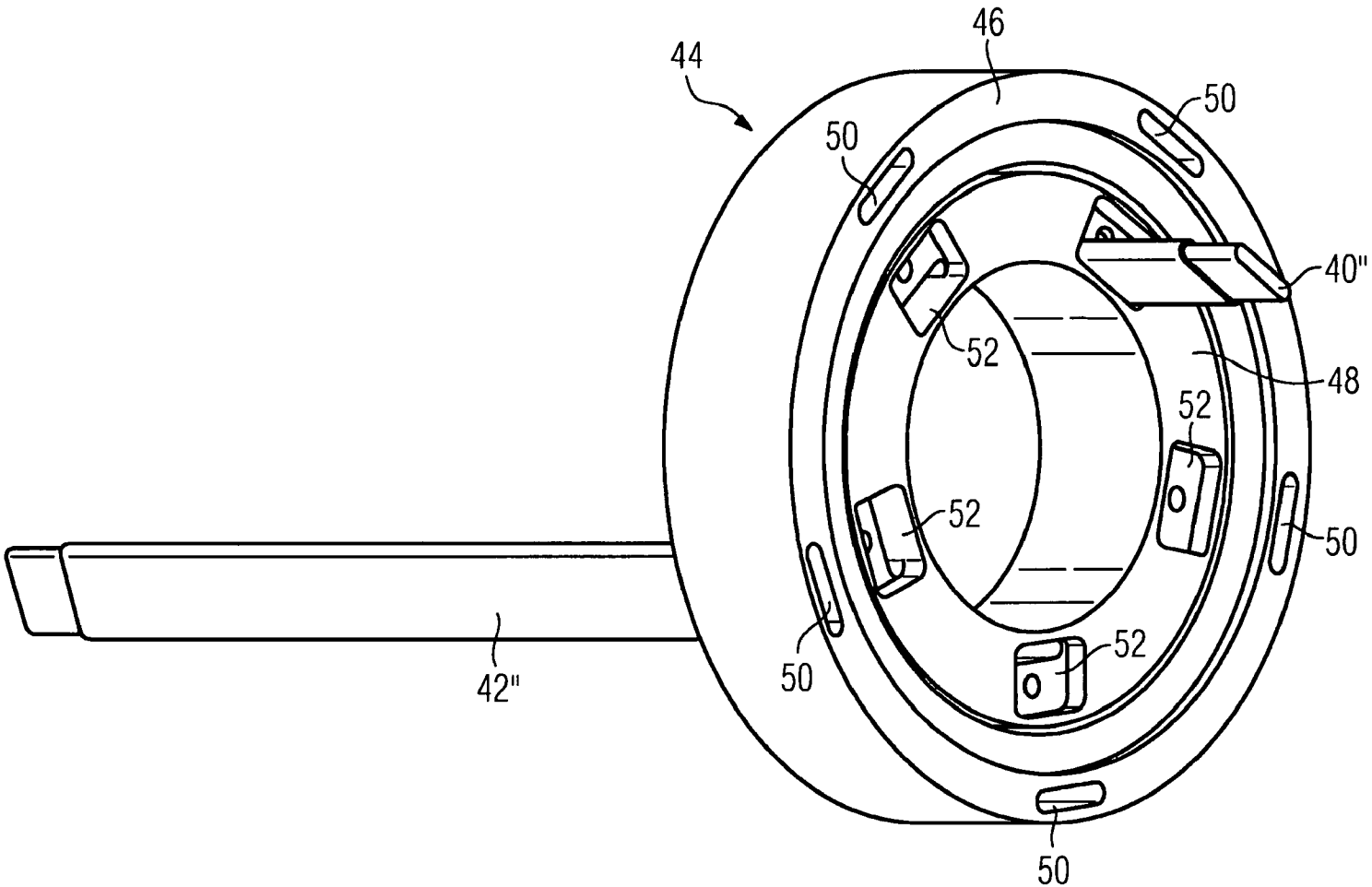
Figure 3B:
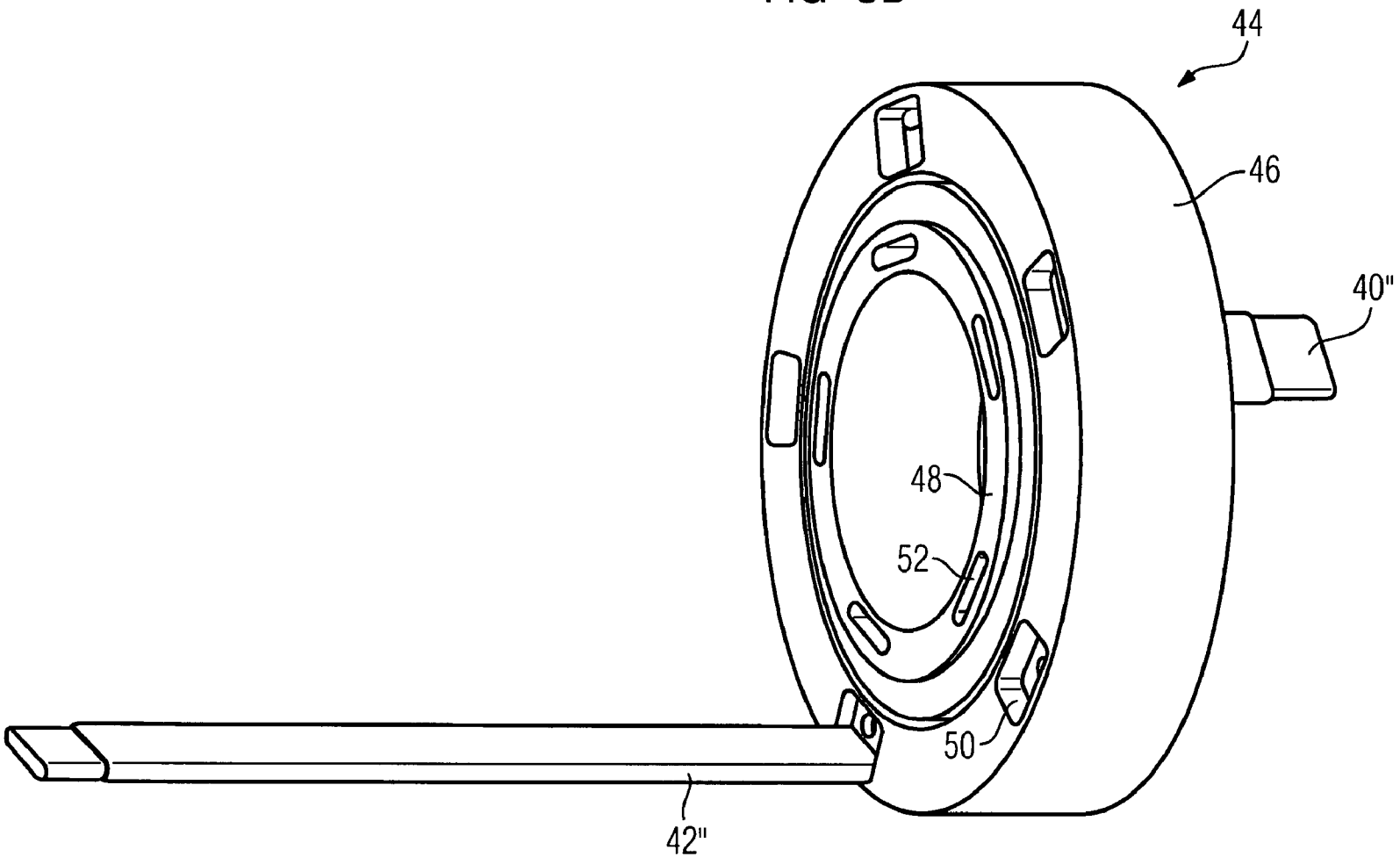

Although in the schematic drawing according to FIG. 1 the lines 40 and 40' are shown in the hollow space of the cylinder of the fixed part 10, in reality provision is made for the lines to be configured in the cylinder wall 14. This is shown clearly in FIG. 2, which shows five lines 40", one supply line for each of the elements 46 of the cylinder wall 16' isolated by the insulating rings 20'. The individual elements 46, which are isolated from one another by the insulating rings 20', can be separate components, as shown in FIG. 3A and FIG. 3B. A structural element designated as a whole as 44, consisting of one structural element 46 for the cylinder wall 16' and one structural element 48 for the cylinder wall 14' is shown. The one current transmission contact in the structural element 44 is not shown. This is a current transmission contact in the manner of the current transmission contact 24 and/or 24' in FIG. 1. This contact requires precisely one supply line 40" and one line 42" on the part of the rotating part 12'. Five through holes 50 for the lines 42", also from the other four structural elements 46, are correspondingly provided in the cylinder wall of the component. Five through holes 52 are correspondingly provided in the cylinder wall 48, also for guiding through the lines 40' from other components 48.

Integrating the power lines 40" and 42" in the respective cylinder walls 14' and/or 16' ensures that the hollow space of the cylinder of the fixed part 10" remains completely empty. Also there are no power lines arranged outside the cylinder wall 16'.

Material, which is supplied by way of the hollow space of the cylinder of the fixed part 10", can be processed by the machine tool or production machine (e.g. multispindle machine), which uses the transmitter unit according to FIG. 2.

The present invention is not specifically for a fixed part inside the interior and a rotating part arranged outside. Instead the invention can be realized in a totally analogous manner in the reverse instance, where the rotating part is arranged in the interior of the fixed part.

The invention claimed is:

1. A machine, comprising:

a fixed part, the fixed part having a first and a second electrically insulated current transmission surface;

a rotating part that rotates in relation to the fixed part, the rotating part having an assigned third and fourth current transmission surface for the first and second current transmission surface on the fixed part;

a first and a second current transmission contact, wherein the third and fourth current transmission surfaces on the rotating part are electrically insulated from one another and form gaps with the associated first and second current transmission surface on the fixed part, the gaps containing liquid metal alloys to form the first and second current transmission contact; and a first electrical consumer fed by the first and second current transmission contact deployed on the rotating part;

wherein the fixed part and the rotating part are arranged cylindrically about a cylinder axis, the rotating part enclosing the fixed part, the fixed and the rotating part each having a basic body in form of a hollow cylinder with a cylinder wall, wherein each cylinder wall includes an insulating ring to separate the cylinder wall into two parts insulated from one another, and wherein current supply systems are guided to the current transmission surfaces in the cylinder walls of the fixed and rotating parts, wherein a ring of U-shaped cross-section is provided on a cylinder wall of the rotating part for each current transmission surface, with the arms of the U-shape running parallel to the cylinder axis, and wherein a ring of L-shaped cross-section is provided on a cylinder wall of the fixed part for each current transmission surface, the first and second current transmission contact being formed by inserting a liquid metal alloy into the ring of U-shaped cross-section with one arm of the ring of L-shaped cross-section engaging in the U-shaped cross-section containing the liquid metal alloy, the engaging arm of the ring of L-shaped cross-section being sealed off from the two aims of the ring of U-shaped cross-section.

2. The machine as claimed in claim 1, wherein the fixed part and the rotating part have each two further current transmission surfaces, so that a third and a fourth current transmission contact for feeding a second electrical consumer are deployed on the rotating part, which produces control signals for the first electrical consumer.

3. The machine as claimed in claim 1, wherein a voltage of 400 to 1000 volts is applied to the first and second current transmission contact and a voltage of 10 to 50 volts is applied to the third and fourth current transmission contact.

4. The machine as claimed in claim 2, wherein a voltage of 400 to 1000 volts is applied to the first and second current transmission contact and a voltage of 10 to 50 volts is applied to the third and fourth current transmission contact.

5. The machine as claimed in claim 1, wherein a fifth contact surface is provided respectively on the fixed part and the rotating part, together forming a gap containing liquid metal alloy, a contact thus foimed is connected to ground.

6. The machine as claimed in claim 4, wherein a fifth contact surface is provided respectively on the fixed part and the rotating part, together forming a gap containing liquid metal alloy, a contact thus formed is connected to ground.

7. The machine as claimed in claim 1, wherein the machine is a machine tool.

8. The machine as claimed in claim 1, wherein the machine is a production machine.

9. The machine as claimed in claim 8, wherein the machine tool is a multispindle machine or a revolving transfer machine.

10. The machine as claimed in claim 1, wherein the machine is a robot.

* * * * *